United States Patent [19]

Nakanishi

[11] 4,414,941

[45] Nov. 15, 1983

[54] METHOD AND APPARATUS FOR FUEL INJECTION IN ELECTRONIC FUEL INJECTION CONTROLLED ENGINES

[75] Inventor: Tatsuaki Nakanishi, Toyota, Japan

[73] Assignee: Toyota Jidosha Kogyo Kabushiki Kaisha, Toyota, Japan

[21] Appl. No.: 326,075

[22] Filed: Nov. 30, 1981

[30] Foreign Application Priority Data

Aug. 7, 1981 [JP] Japan ..... 56-123099

[51] Int. Cl.[3] ..... F02D 31/00

[52] U.S. Cl. ..... 123/326; 123/325

[58] Field of Search ..... 123/325, 326

[56] References Cited

U.S. PATENT DOCUMENTS

| | | | |
|---|---|---|---|
| 2,879,756 | 3/1959 | Cornelius | 123/326 |
| 3,835,825 | 9/1974 | Baxendale | 123/326 |
| 4,242,991 | 1/1981 | Scherenberg | 123/326 |

*Primary Examiner*—Ronald B. Cox

*Attorney, Agent, or Firm*—Cushman, Darby & Cushman

[57] ABSTRACT

Fuel is cut off during deceleration and detection of a racing condition. The racing and deceleration detected by the rate of reduction of the rotational speed of the engine. In the case of fuel cut-off during the racing condition, the fuel injection amount after completion of fuel cut-off is increased. A plurality of injections of increased fuel are carried out once every two cycles of the engine.

10 Claims, 4 Drawing Figures

METHOD AND APPARATUS FOR FUEL INJECTION IN ELECTRONIC FUEL INJECTION CONTROLLED ENGINES

BACKGROUND OF THE INVENTION

1. Field of the Invention

This invention relates to a method of and apparatus for fuel injection in an electronic fuel injection controlled engine which controls an amount of fuel injected from a fuel injection valve in an intake system by operating the fuel injection valve according to electric signals.

2. Description of the Prior Art

While the rotational speed in the idling condition of an electronic fuel injection cotrolled engine is set to a predetermined value, it tends to be reduced as time goes by or the electric load increases. While in the racing condition (high speed idling) fuel is cut off to restrain fuel consumption and purged amounts of harmful components until the rotational speed of the engine is reduced to a value lower than the predetermined value, the fuel injection amount in the idling state is also reduced as the rotational speed in the idling state is reduced so that the reduction of the rotational speed of the engine can not be sufficiently restrained and sometimes the rotation of the engine may be stopped (engine stalls) in spite of the resumption of fuel injection. This provides an obstacle to the further reduction of the rotational speed of the engine during the resumption of fuel injection to improve fuel consumption.

SUMMARY OF THE INVENTION

An object of the present invention is to provide a fuel injection method of and apparatus for an electronic fuel injection controlled engine which can positively prevent the stoppage of the rotation of the engine during the resumption of fuel injection after cut-off of the fuel due to detection of the racing condition even if the rotational speed of the engine is set to a low value after resumption of the fuel injection.

According to the fuel injection method and apparatus of the electronic fuel injection controlled engine of the present invention, which method and apparatus controls an amount of fuel injected from a fuel injection valve in an intake system by operating the fuel injection valve according to electric signals, to achieve this object the fuel is cut-off for a period and the racing condition is detected from the rate of reduction of the rotational speed of the engine during the fuel cut-off period. The fuel injection amount after the resumption of fuel injection after the fuel cut-off due to the racing condition is increased more than the fuel injection amount after the resumption of fuel injection after the fuel cut-off due to the idling condition for the same rotational speed of the engine to provide a period of at least one cycle of the engine between a plurality of times of fuel injection in which the fuel amount is increased for the resumption of the fuel injection.

Consequently, since the fuel injection amount for the resumption of fuel injection is increased to ensure a sufficient output of the engine, the rotation of the engine is prevented from stoppage after the resumption of fuel injection. If the fuel injection for the resumption thereof is carried out every cycle of the engine, the mixture in the combustion chambers becomes overrich due to the injection of increased fuel and unburnt components in the residual gas not purged in the exhaust stroke but left in the combustion chamber or returned from the intake system to the combustion chamber thereby degrading the combustion. However, since a period of at least one cycle of the engine is provided between a plurality of fuel injections the resumption of fuel injection according to the present invention the degradation of the combustion is avoided.

Whether or not fuel is cut off by the racing condition is preferably judged according to the rate of reduction of the rotational speed of the engine. Since the engine is disengaged from a drive gear during the racing condition, the rate of reduction of the rotational speed of the engine during the fuel cut-off period due to the racing condition is larger than the rate of reduction of the rotational speed of the engine during the fuel cut-off period due to the deceleration condition.

The fuel injection is synchronized with the rotation of the engine so that the rotational speed of the engine can be detected by the primary current of the ignition coil.

The fuel injection amount after the resumption of the fuel injection is preferably determined by increasing and compensating the basic fuel injection amount based upon the intake air flow and rotational speed of the engine.

The above-mentioned and other objects and features of the present invention will become apparent from the following detailed description taken in conjunction with the drawings which indicate one embodiment of the present invention.

DESCRIPTION OF THE PREFERRED EMBODIMENTS

Figure 1:
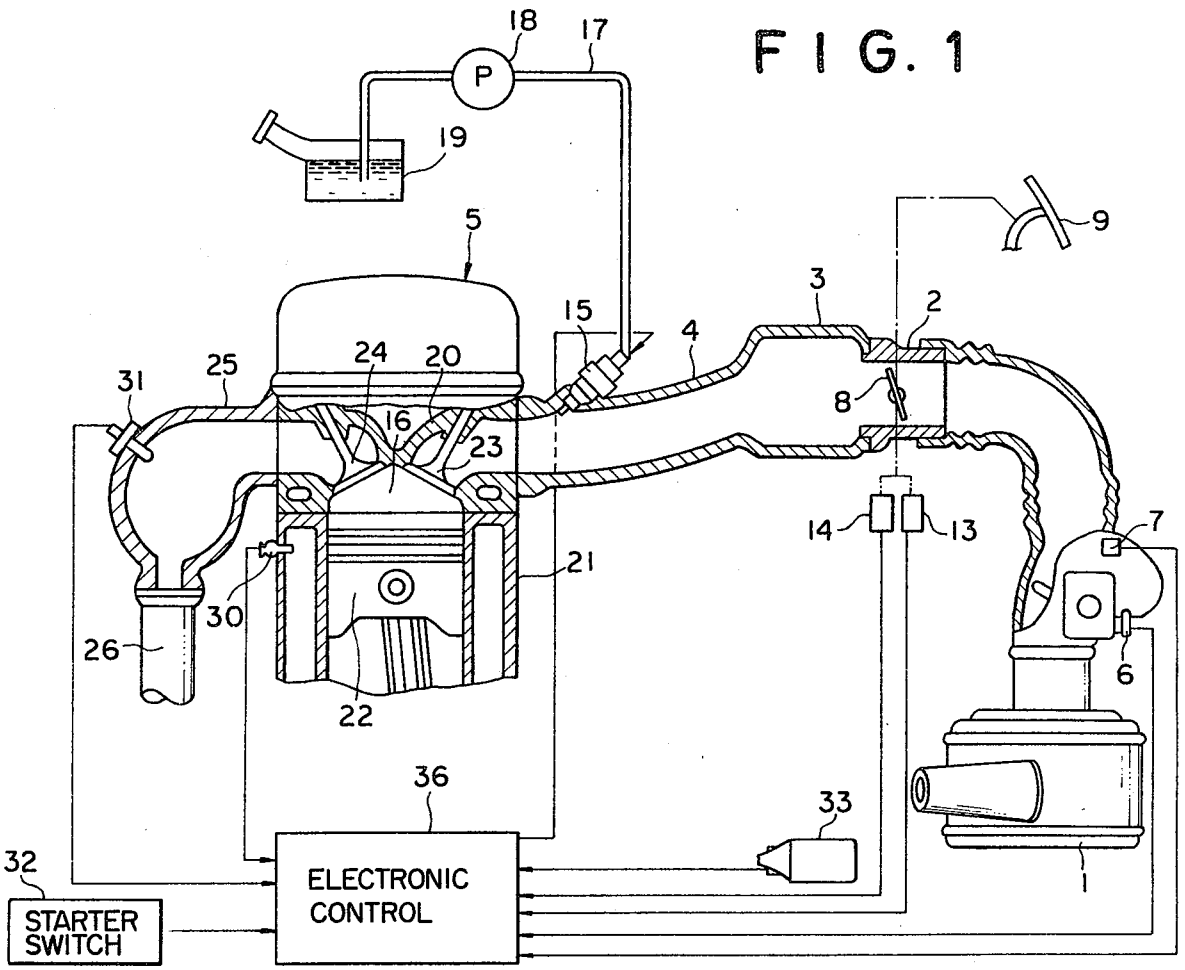
FIG. 1 is a schematic drawing of an electronic fuel injection controlled engine according to the present invention.

Hereinafter will be described an embodiment of the present invention with reference to the drawings. An intake system comprises, sequentially from the upstream side, an air cleaner 1, a throttle body 2, a surge tank 3 and an intake conduit 4 connected to an engine body 5. An air flow meter 6 provided between the air cleaner 1 and throttle body 2 detects intake air flow, and an intake temperature sensor 7 is provided close to the air flow meter 6. The throttle body 2 is provided with a throttle valve 8 which is interlocked with an accelerator pedal 9 in a cab to control the intake air flow. An idle switch 13 detects the idle opening of the throttle valve 8 and a power switch 14 detects that the throttle valve 8 has an opening larger than a predetermined one, i.e high load time requiring high output of the engine. An electromagnetic fuel injection valve 15 is directed to each combustion chamber 16 of the engine body 5 and mounted on the intake conduit 4 to inject fuel forcibly sent through a fuel path 17 from a fuel tank 19 by a fuel pump 18 in response to input signals. The combustion chamber 16 is defined by a cylinder head 20, a cylinder block 21 and a piston 22. A mixture supplied through an intake valve 23 to the combustion chamber 16 is purged to the atmosphere through an exhaust valve 24, an exhaust manifold 25 and an exhaust pipe 26 as exhaust gas after combustion. A water temperature sensor 30 mounted on the cylinder block 21 detects cooling water temperature, and an air fuel ratio sensor 31 mounted on the exhaust manifold 25 detects the oxygen concentration in the exhaust gas, i.e. air fuel ratio of the mixture. Further, a starter switch 32 detects an engine key located in the starting position, an ignition coil 33 sends secondary current to a distributor (not shown) and the rotational speed of the engine is detected through primary current of the ignition coil 33. An electronic control 36 receives detecting singals of the air flow meter 6, intake temperature sensor 7, idle switch 13, power switch 14, water temperature sensor 30, air fuel ratio sensor 31, starter switch 32 and ignition coil 33 to send electric pulse signals to the fuel ignition valve 15.

Figure 2:
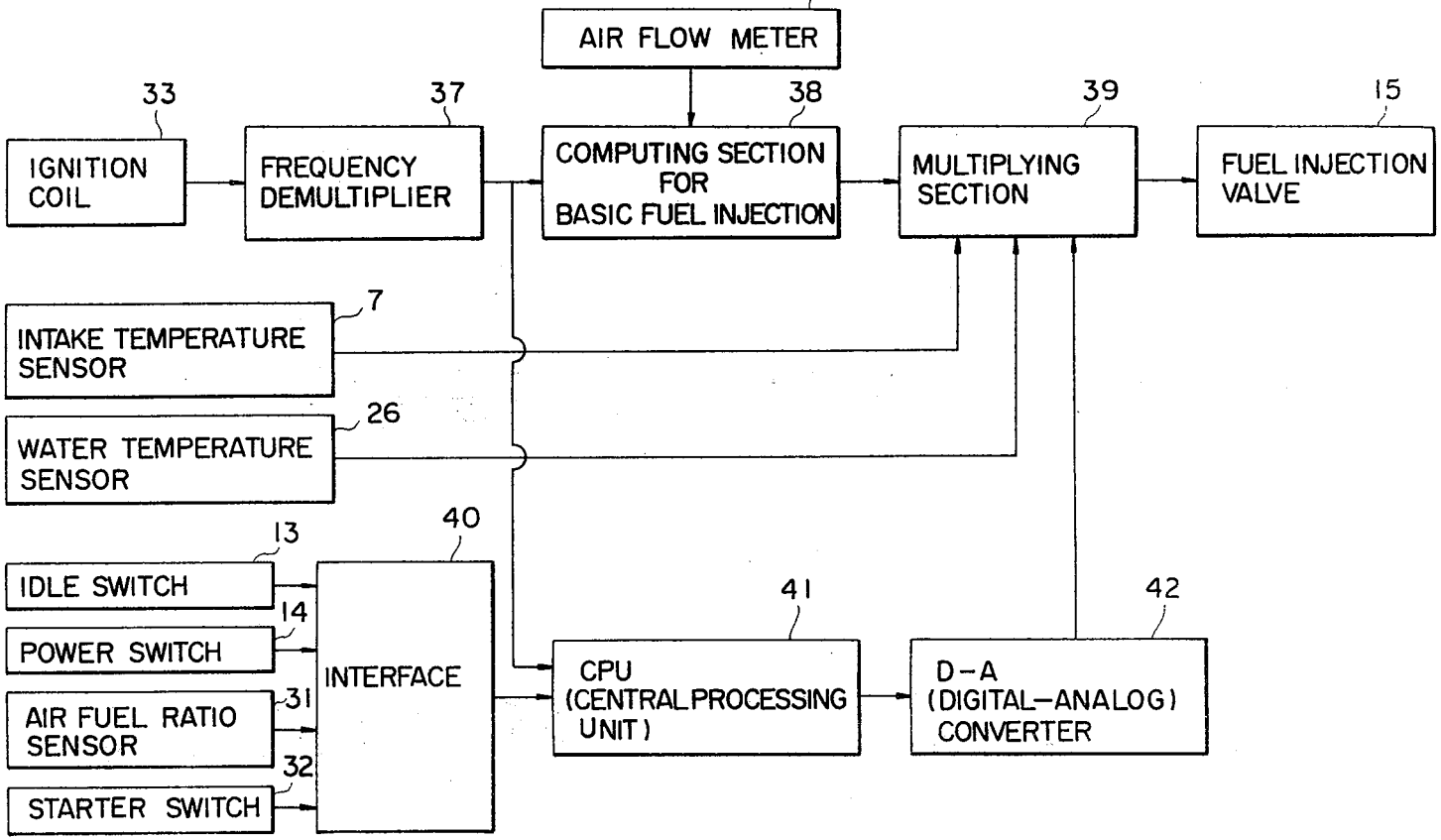
FIG. 2 is a detailed block diagram of the interior of an electronic control shown in FIG. 1.

FIG. 2 is a detailed block diagram of the interior of the electronic control 36. The primary current of the ignition coil 33 is sent to a frequency demultiplier 37 which is comprised of a flip-flop for reversing the output with the input trigger of the primary current pulse of the ignition coil 33. Since the primary current of the ignition coil 33 is proportional to the rotational speed N of the engine, the pulse width of the output pulse from the frequency demultiplier 37 is proportional to 1/N. The output of the frequency demultiplier 37 is sent to a computing section 38 for the basic fuel injection amount, which section is comprised of a capacitor. This capacitor is charged with a predetermined charging current while the output of the frequency demultiplier 37 is "1" (hereinafter high level voltage is defined by "1" and low level voltage by a "0") and discharged by discharging current proportional to the input voltage from the air flow meter 6 when the output of the frequency demultiplier 37 is reversed from "1" to "0". The output voltage of the air flow meter 6 is inversely proportional to intake air flow Q. The basic fuel injection amount computing section 38 maintains the output at "1" during the discharging time of the capacitor, i.e the period from the beginning of discharge of the capacitor to the exhaustion of voltage across the capacitor. Thus, the pulse width of the output pulse from the basic fuel injection amount computing section 38 is proportional to Q/N. The output of the basic fuel injection amount computing section 38 is sent to a multiplying section 39 which is comprised of a capacitor. This capacitor is charged while the output of the basic fuel injection amount computing section 38 is maintained at "1" and discharged while such output is maintained at "0". The outputs of the idle switch 13, power switch 14, air fuel ratio sensor 31 and starter switch 32 are input to a CPU (Central Processing Unit) 41 through an interface 40. The output signal of the frequency demultiplier 37 representing the rotational speed of the engine is also input to the CPU 41. The CPU 41, comprised of a microcomputer, computes the compensation amount of the fuel injection amount from these input signals and the signal output from the frequency demultiplier, and the output of CPU 41 is input to the multiplying section 39 through a D-A (Digital-Analog) converter 42. The charging current and discharging current for the capacitor in the multiplying section 39 vary with the outputs of the intake temperature sensor 7, water temperature sensor 26 and D-A converter 42, and the multiplying section 39 maintains its output at "1" while the voltage across its capacitor has a value larger than zero. Thus, the pulse width of the output pulse from the multiplying section 39 has a value of Q/N compensated by the running condition of the engine. The output pulse of the multiplying section 39 is sent to the fuel injection valve 15 as fuel injection pulse. The fuel injection valve 15 is opened to inject fuel while it receives the fuel injection pulse as the input. Since the internal combustion engine of this embodiment has four cylinders, four fuel injection valves 15 are provided, and the four fuel injection valves 15 receive simultaneously the fuel injection pulses from the multiplying section 39. Further, refer to Automotive Electronics II, Closed loop control, pages 141–143, published by SAE (Society of Automotive Engineers), Feb. 1975 for the details of the frequency demultiplier 37, basic fuel injection amount computing section 38 and multiplying section 39.

CPU 41 calculates the fuel cut-off period in relation to the opening of the throttle valve 8 and the rotational speed N of the engine. The multiplying section 39 during the fuel cut-off period stops the output of the pulse to the fuel injection valve 15 according to the input signal from the D-A converter 42.

Figure 3:
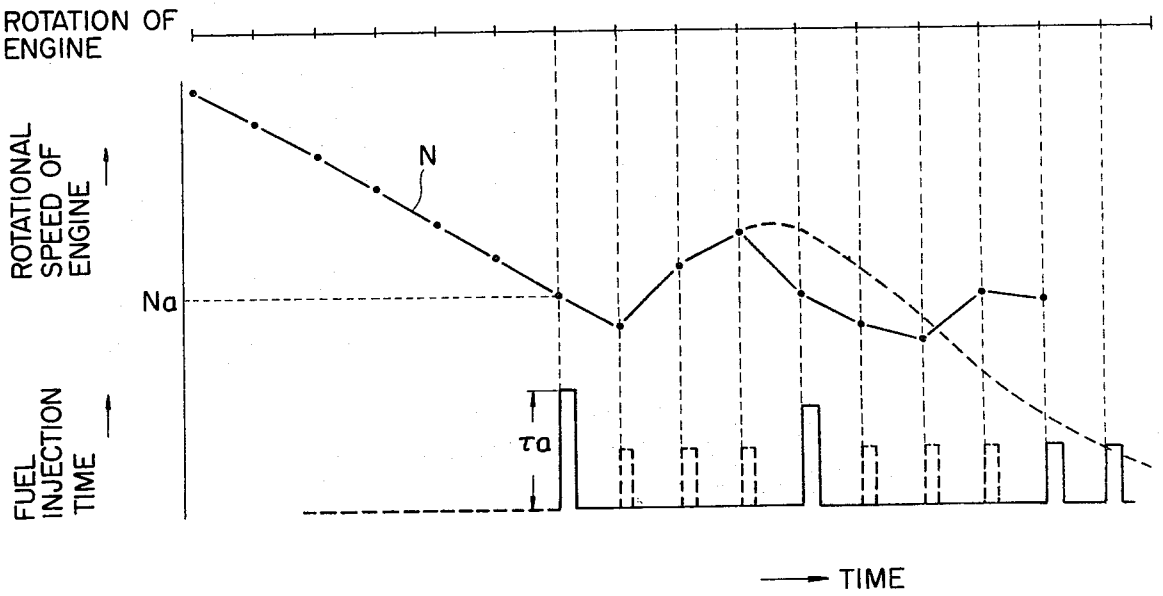
FIG. 3 is an explanatory drawing showing the change with the passage of time of the rotation, rotational speed and fuel injection time of the engine.

FIG. 3 shows the relationship between the rotation, rotational speed and fuel injection time of the engine when the fuel injection is resumed after the fuel cut-off due to the detection of the racing condition. In the abscissa representing the rotation of the engine, an interval of the scale corresponds to one rotation, i.e. 360° of crank angle, and fuel is injected in synchronization with the rotation of the engine. CPU 41 detects whether it is confronted with the racing condition from the change in the rotational speed N with respect to time, dN/dt (where t is time), i.e. value of the rotation of the engine differentiated secondarily with respect to t. Further, the rate of reduction of the rotational speed of the engine is equal to $-dN/dt$. Since the engine is disengaged from the drive gear during the racing condition, $|dN/dt|$ during the racing condition is larger than $|dN/dt|$ during deceleration. When the rotational speed N of the engine is lower than Na, the fuel injection is resumed. The pulse width $\tau a$ of the first fuel injection pulse after the resumption of the fuel injection is larger than the pulse width $\tau b$ of the fuel injection pulse calculated on the basis of the rotational speed of the engine during the idling condition. Thus, the fuel injection amount from the fuel injection valve 15 is increased to prevent the rotational speed of the engine from drastic reduction and avoid the stoppage of the engine rotation. When the fuel injection pulse having the enlarged width is produced in every cycle of the engine, the mixture not exhausted from the combustion chamber or returned from the exhaust system to the combustion chamber contains a considerable amount of unburnt components and the large amount of injected fuel makes an abnormally overrich mixture in the combustion chamber 16 which degrades combustion. Thus, fuel is not injected every cycle of the engine, but at least once for every two cycles of the engine. Since in this embodiment the engine is of a four cycle type, fuel is injected once for every four rotations of the crankshaft. When in this embodiment the rotational speed of the engine is sufficiently stabilized and the crankshaft is rotated eight times after the resumption of the fuel injection, the fuel injection pulse width is returned to the normal value. Further, in FIG. 3, the pulse pattern shown by the broken line and representing the fuel injection time represents the fuel injection time and period of time during the idling condition after sufficient time elapses since the resumption of the fuel injection. The rotational speed of the engine shown by the broken line represents one in the case where fuel is injected at every revolution of the crankshaft after the resumption of the fuel injection.

Figure 4:
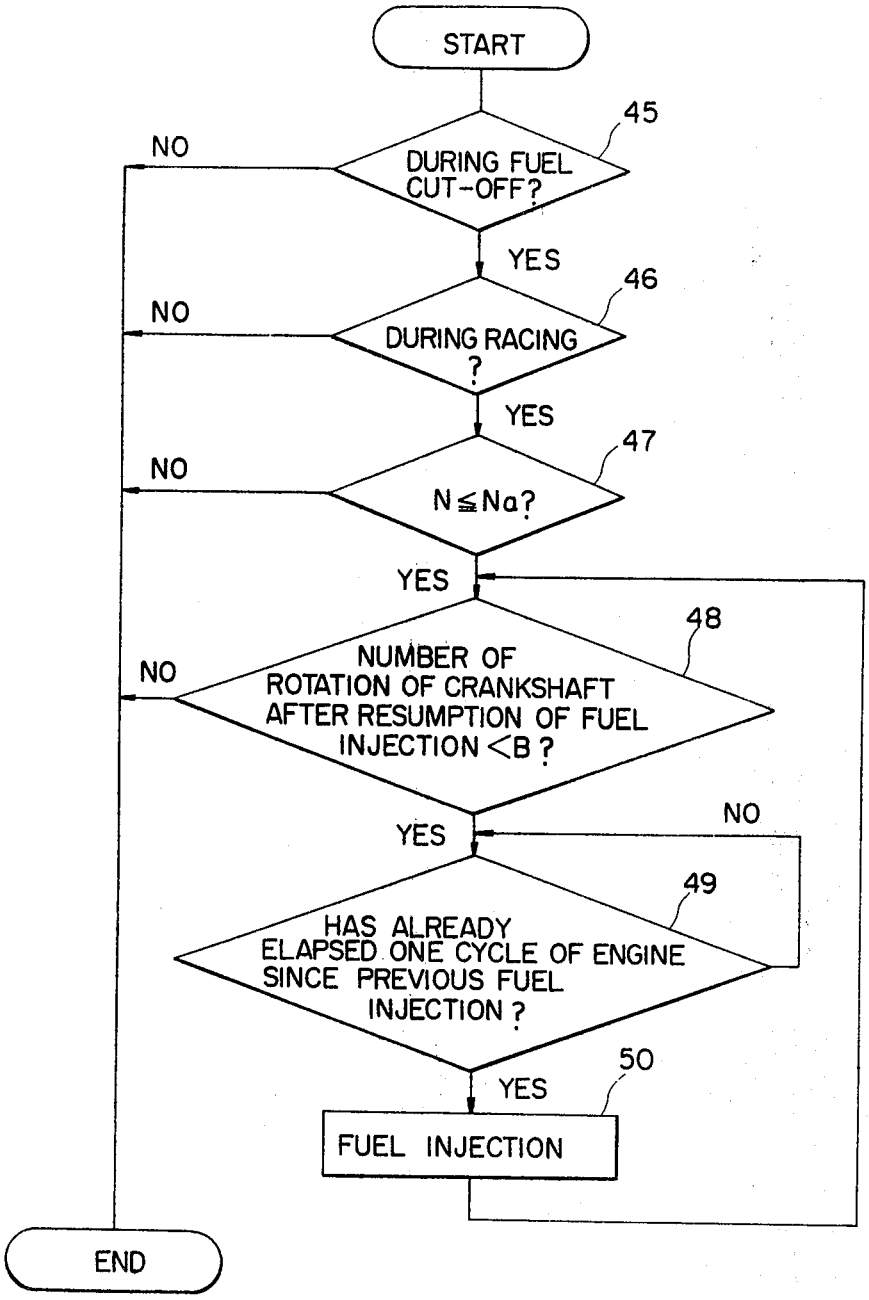
FIG. 4 is a flow chart of a program for an embodiment of the present invention.

FIG. 4 is a flow chart of an embodiment of the present invention. In step 45 it is judged whether or not fuel is being cut off, and the program proceeds to step 46 if it is judged yes and terminates if no. In step 46 it is judged whether or not $|dN/dt| \geqq A$ (provided A is a predetermined positive value) is satisfied, i.e. the engine is in the racing condition, and the program proceeds to step 47 if it is judged yes and terminates if no. In step 47 it is judged whether or not $N \leqq Na$ is satisfied, i.e. the rotational speed N of the engine is reduced to a value lower than Na after the resumption of the fuel injection, and the program proceeds to step 48 if it is judged yes and terminates if no. In step 48 it is judged whether or not the number of rotations of the crankshaft after the resumption of the fuel injection is smaller than a predetermined value B and the program proceeds to step 49 if it is judged yes and terminates if no. In the description of FIG. 3, B is equal to eight, and when the number of rotations of the crankshaft after the resumption of the fuel injection exceeds eight, the increase of the fuel injection time for the resumption of the fuel injection is stopped and thereafter fuel is injected from the fuel injection valve 15 at every rotation of the crankshaft in synchronization with the rotation of the crankshaft in the fuel injection time during the normal idling time. In step 49 it is judged whether or not one cycle of the engine has already elapsed since the previous fuel injection for the resumption of the fuel injection, and the program proceeds to step 50 if it is judged yes and step 49 if no. In step 50 is injected fuel having the fuel injection amount increased and the program returns to step 48.

Thus, according to the present invention, since in the resumption of the fuel injection after fuel cut-off due to the detection of the racing condition a properly increased amount of fuel is injected, the stoppage of engine rotation can be avoided to effectively improve fuel consumption even if the rotational speed of the engine is set to a considerably low value after the resumption of the fuel injection. Also, since a plurality of fuel injections supplying increased fuel are carried out once at least every two cycles of the engine, the degradation of combustion is prevented.

What is claimed is:

1. A fuel injection method for an electronic fuel injection controlled engine for controlling an amount of fuel injected from a fuel injection valve in an intake system by operating the fuel injection valve according to electric signals, said method comprising:

detecting a fuel cut-off period;

detecting the rate of reduction of the rotational speed of the engine during the fuel cut-off period;

descrimination between racing and idling conditions of the engine;

resuming the injection of fuel;

increasing, for a predetermined period of time, the fuel injection amount after the resumption of fuel injection after a fuel cut-off period caused by the racing condition more than for a fuel cut-off period caused by an idling condition even at the same rotational speed of the engine after the resumption of the fuel injection; and providing a period of at least one cycle of the engine between the plurality of injection times of the increased fuel injection amounts after the resumption of fuel injection.

2. A fuel injection method as defined in claim 1, wherein the step of descriminating includes comparing the rate of reduction of the rotational speed of the engine during the fuel cut-off period to a predetermined value, and judging the engine to be in the racing condition when the rate exceeds the predetermined value.

3. A fuel injection method as defined in claim 2, wherein the step of resuming the injection of fuel includes injecting fuel in synchronization with the rotation of the engine.

4. A fuel injection method as defined in claim 3, including the step of detecting the rotational speed of the engine by measuring the primary current of an ignition coil.

5. A fuel injection method as defined in claim 4, including the step of measuring the intake air flow, and wherein the step of increasing the fuel injection amount after the resumption of fuel injection includes incrementally compensating the basic fuel injection amount defined on the basis of intake air flow and rotational speed of the engine.

6. A fuel injection apparatus for an electronic fuel injection controlled engine for controlling an amount of fuel injected from a fuel injection valve in an intake system by operating the fuel injection valve according to electric signals, said apparatus comprising:

means for detecting the rotational speed of the engine;

and processing means for, detecting a fuel cut-off period, detecting from the rotational speed of the engine the rate of reduction of the rotational speed, descriminating from the rate of reduction of the rotational speed between idling and racing conditions of the engine, resuming the production of the fuel injection valve electric signals, increasing for a predetermined period of time the fuel injection amount after the resumption of fuel injection after a fuel cut-off period caused by the racing condition more than for a fuel cut-off period caused by an idling condition even at the same rotational speed of the engine after the resumption of the fuel injection, and providing a period of at least one cycle of the engine between the plurality of injection times of the increased fuel injection amounts after the resumption of fuel injection.

7. A fuel injection apparatus as defined in claim 6, wherein the processing means descriminates between the idling and racing conditions by comparing the rate of reduction of the rotational speed of the engine during the fuel cut-off period to a predetermined value, and judges the engine to be in the racing condition when the rate exceeds the predetermined valve.

8. A fuel injection apparatus as defined in claim 7, wherein the processing means produces the fuel injection valve electric signals such that fuel is injected in synchronization with the rotation of the engine.

9. A fuel injection apparatus as defined in claim 8, including an ignition coil, and wherein the means for detecting the rotational speed of the engine includes means for measuring the primary current of the ignition coil.

10. A fuel injection apparatus as defined in claim 9, including means for measuring the intake air flow, and wherein the processing means increases the fuel injection amount after the resumption of fuel injection by incrementally compensating a basic fuel injection amount defined on the basis of the intake air flow and the rotational speed of the engine.

* * * * *